US006440322B1

(12) United States Patent
Kim et al.

(10) Patent No.: US 6,440,322 B1
(45) Date of Patent: Aug. 27, 2002

(54) MAGNETIC FLUID AND PROCESS FOR THE PRODUCTION THEREOF

(75) Inventors: Young-sam Kim, Pusan (KR); Katsuto Nakatsuka, 3-5-1403, Moniwadai 4-chome, Taihaku-ku, Sendai-shi, Miyagi 982-0252 (JP); Toyohisa Fujita, Akita (JP); Takafumi Atarashi, Tokyo (JP)

(73) Assignees: Nittetsu Mining Co., Ltd., Tokyo (JP); Katsuto Nakatsuka, Miyagi (JP)

( * ) Notice: Subject to any disclaimer, the term of this patent is extended or adjusted under 35 U.S.C. 154(b) by 0 days.

(21) Appl. No.: 09/508,618

(22) PCT Filed: Sep. 11, 1998

(86) PCT No.: PCT/JP98/04122

§ 371 (c)(1),
(2), (4) Date: Jun. 9, 2000

(87) PCT Pub. No.: WO99/14767

PCT Pub. Date: Mar. 25, 1999

(30) Foreign Application Priority Data

Sep. 16, 1997 (JP) ..... 9-250713

(51) Int. Cl.[7] ..... H01F 1/28; H01F 1/34
(52) U.S. Cl. ..... 252/62.52; 252/62.55
(58) Field of Search ..... 252/62.52, 62.55

(56) References Cited

U.S. PATENT DOCUMENTS

| | | | | |
|---|---|---|---|---|
| 4,113,528 A | | 9/1978 | Tokuoka et al. | 148/205 |
| 5,507,967 A | * | 4/1996 | Fujita et al. | 252/62.52 |
| 5,523,157 A | * | 6/1996 | Sasaki et al. | 428/403 |
| 5,578,238 A | * | 11/1996 | Weiss et al. | 252/62.52 |
| 5,702,630 A | * | 12/1997 | Sasaki et al. | 252/62.52 |

FOREIGN PATENT DOCUMENTS

| | | | |
|---|---|---|---|
| JP | 52-69859 | | 6/1977 |
| JP | 54015195 | * | 2/1979 |
| JP | 58-161709 | | 9/1983 |
| JP | 02069859 | * | 3/1990 |
| JP | 7-90290 | | 4/1995 |

OTHER PUBLICATIONS

Office Action dated Jan. 9, 2002 in Japanese Patent Application No. Hei. 9–250713 and English translation.

* cited by examiner

*Primary Examiner*—C. Melissa Koslow
(74) *Attorney, Agent, or Firm*—Sughrue Mion, PLLC

(57) ABSTRACT

A magnetic fluid and a process for producing the same are provided. The magnetic fluid is an excellent fluid which mightily and precisely actuates by the action of an external magnetic field so that its viscosity can be significantly increased and be easily and precisely controlled by regulating the external magnetic field applied thereto. The magnetic fluid is also excellent in the unsusceptibility to oxidation and dispersibility of the particles and has a sufficiently wide viscosity range. The magnetic fluid comprises magnetic metal particles coated with an oxidation-preventive film stably dispersed in a solvent, wherein the dispersion conditions are maintained, and the process for producing the fluid comprises forming an oxide film on the surface of raw oxide particles of magnetic metal particles, reducing the raw oxide particles coated with the oxide film to obtain magnetic metal particles coated with an oxidation-preventive film, and stably dispersing the magnetic metal particles coated with an oxidation-preventive film in a solvent.

5 Claims, No Drawings

MAGNETIC FLUID AND PROCESS FOR THE PRODUCTION THEREOF

TECHNICAL FIELD

The present invention relates to a magnetic fluid and a process for producing the same. In particular, the present invention relates to a magnetic fluid suitable for use as a working fluid for dampers, actuators, shaft seals, vacuum seals, dynamic bearings, and the like, and to a process for producing the same.

BACKGROUND ART

A magnetic fluid obtained by extremely stably dispersing fine magnetic metal oxide particles, such as magnetite, in a liquid phase is such a functional fluid that it is flowable but, by the application of a magnetic field, the particles in the liquid can be quickly and reversibly actuated and the fluid can be quickly and reversibly changed in flowability, viscosity, and the like, and be changed into even gel conditions showing no flowability. Since the viscosity of such magnetic fluids can hence be easily controlled by an external magnetic field, use of these fluids as working fluids for various mechanical devices, including dampers, actuators, shaft seals, vacuum seals, dynamic bearings, and the like, has been investigated.

A known magnetic fluid containing a metal oxide is an oil-based fluid prepared by causing magnetite particles to adsorb oleic acid and dispersing these particles in kerosine (JP-A-53-17118).

Furthermore, a technique for obtaining a water-based magnetic liquid is disclosed (JP-A-54-40069). In this technique, magnetite prepared by a wet process is caused to adsorb oleic acid in an aqueous solution thereof, and the resultant flocculate is converted through filtration to a cake having a water content of about 50%. This cake is transferred to a beaker, and a solid powder of sodium dodecylbenzenesulfonate is added thereto, followed by stirring, and thus the filtration cake disperses to rapidly become a low-viscosity liquid to give a water-based magnetic liquid.

A method of dispersing fine iron particles in a mercury matrix by electrodeposition has been used in investigating the magnetism of fine iron particles. By this method, an iron-containing magnetic fluid based on a liquid metal has been obtained (J. Van Wonterghem, S. Morup, S. W. Charles, and S. Wells, *J. Mag. Mag. Master.,* 65: 276 (1987)).

And, when such an iron-containing magnetic fluid is exposed to the air, the value of magnetization thereof rapidly decreases due to that the fine iron particles are susceptible to oxidation in the air. Hence, a method and apparatus for obtaining a magnetic fluid containing fine iron nitride particles, which are chemically more stable than iron and have a high saturation magnetization and a high electrical conductivity, have been disclosed (JP-A-3-187907 and JP-A-5-70784). This method comprises introducing a vapor of iron carbonyl ($Fe(CO)_5$) simultaneously with $N_2$ gas into a heater to decompose the $Fe(CO)_5$ and yield iron nitride ($Fe_3N$ or $Fe_4N$), and thus a magnetic fluid containing iron nitride is synthesized.

However, no magnetic fluid which fully satisfies high magnetism and unsusceptibility to oxidation has been obtained so far. Problems include the following.

Magnetic fluids which are fluids actuating in response to a magnetic field employ an iron-based oxide, metallic iron, or a nitride as ultrafine particles of a magnetic material so as to keep the dispersed particles in colloidal conditions.

Such oxides are insufficient in magnetism, while the metal and nitrides have a problem concerning stability due to that they oxidize in air in several months. Consequently, the practical use of those magnetic fluids is limited to applications in vacuum or inert gases.

For obtaining a mighty magnetic actuation in an oxide-containing magnetic fluid conventionally used frequently, it is necessary to heighten the intensity of an external magnetic field applied thereto, or to heighten the concentration of particles in the fluid, or to use magnetic particles having a larger diameter. However, to heighten the intensity of the applied magnetic field is undesirable from the standpoint of energy consumption. To heighten the concentration of particles is also disadvantageous in that not only the particles, when present at a concentration which is too high, are apt to microscopically aggregate to show impaired dispersibility, but also an external magnetic field does not effectively act on the particles due to that the particles have a shielding effect on each other.

On the other hand, in the case of using particles having a larger diameter, each magnetic particle is not constituted of only one magnetic domain, thereby posing the following problems. These particles magnetically aggregate, and the aggregate particles are too heavy to be dispersed by the thermal movement thereof. As a result, the particles sediment in the solvent to cause phase separation, leading to a reduced or no magnetic effect.

As explained above, no magnetic fluid for general use which has properties sufficient for practical use has been obtained so far.

Problems which should be especially solved are as follows. With respect to the magnetic fluid containing a metal oxide, a fluid which is unsusceptible to oxidation and contains particles having a relatively small particle diameter (5 nm to 15 nm) has been obtained. However, this magnetic fluid has poor magnetism. For example, when this magnetic fluid is used in a pressure seal such as a vacuum seal, the seal should have a multistage structure, and the seal structure per se is large and complicated.

Another problem is that the magnetic fluid containing a metal and that containing iron nitride are susceptible to oxidation although having high magnetism, and cannot hence be used in air, water, or the like.

Accordingly, an object of the present invention is to eliminate the problems described above and provide an excellent magnetic fluid which mightily and precisely actuates by the action of an external magnetic field, the viscosity of which can be significantly increased and be easily and precisely controlled by regulating the external magnetic field applied thereto, and which is excellent also in the unsusceptibility to oxidation and dispersibility of the particles and has a sufficiently wide viscosity range. Another object of the present invention is to provide a process for producing the magnetic fluid.

DISCLOSURE OF THE INVENTION

The present inventors made intensive studies in order to eliminate the problems described above. As a result, they have found that the objects of the present invention are accomplished by preparing magnetic metal particles coated with an oxidation-preventive film by forming an oxidation-preventive film on the surface of ultrafine particles of a magnetic metal, as magnetic particles, or reducing a raw magnetic metal oxide coated beforehand with a hydroxide film and then dispersing the magnetic metal particles coated with an oxidation-preventive film in a solvent.

That is, the invention provides the following:

(1) A magnetic fluid comprising magnetic metal particles coated with an oxidation-preventive film stably dispersed in a solvent, wherein the dispersion conditions are maintained.

(2) The magnetic fluid according to the above (1), wherein the magnetic metal particles coated with an oxidation-preventive film have an average particle diameter of from 5 to 20 nm.

(3) The magnetic fluid according to the above (1), wherein the magnetic metal particles coated with an oxidation-preventive film have a saturation magnetization of from 70 to 200 emu/g.

(4) The magnetic fluid according to the above (1), wherein the magnetic metal particles coated with an oxidation-preventive film comprise iron or an iron-containing alloy as the metallic component.

(5) The magnetic fluid according to the above (1), wherein the oxidation-preventive film has a thickness of from 0.01 to 2 nm.

(6) The magnetic fluid according to the above (1), wherein the oxidation-preventive film is an oxide film.

(7) The magnetic fluid according to the above (6), wherein the oxide film is a silica film.

(8) A process for producing a magnetic fluid, comprising forming a hydroxide film on the surface of raw oxide particles of magnetic metal particles, reducing the raw oxide particles coated with the hydroxide film to obtain magnetic metal particles coated with an oxidation-preventive film, and stably dispersing the magnetic metal particles coated with an oxidation-preventive film in a solvent.

(9) The process for producing a magnetic fluid according to the above (8), wherein the raw oxide particles of magnetic metal particles have a particle diameter of from 5 to 20 nm.

(10) The process for producing a magnetic fluid according to the above (9), wherein the raw oxide particles of magnetic metal particles are magnetite.

(11) The process for producing a magnetic fluid according to the above (8), wherein the raw oxide particles coated with a hydroxide film are reduced by calcining at 300 to 800° C. in a hydrogen gas atmosphere.

(12) The process for producing a magnetic fluid according to the above (8), wherein the magnetic metal particles coated with an oxidation-preventive film are dispersed in a solvent after the surface of the particles is treated so as to have an affinity for solvents.

Due to the constitutions described above, the present invention has effects that a magnetic fluid having a magnetism at least two times those of conventional magnetite-containing magnetic fluids can be obtained, and that a high-performance magnetic fluid having unsusceptibility to oxidation and satisfactory dispersion stability can be easily obtained. The oxidation-preventive film serves also to prevent the magnetic particles, when contained at a high concentration, from being magnetically shielded by each other.

Examples of the metallic ingredient serving as the base of the magnetic metal particles coated with an oxidation-preventive film which are used in the magnetic fluid in the present invention include metals, such as iron, cobalt, nickel, chromium, titanium, manganese, aluminum, copper, samarium, neodymium, and the like, and metal alloys, such as iron-nickel, iron-cobalt, iron-copper, iron-cobalt-aluminum alloys, and the like.

In the magnetic fluid of the present invention, the oxidation-preventive film functions to prevent the metallic ingredient serving as the base of the magnetic metal particles from oxidizing over long or semipermanently. The material of the oxidation-preventive film is not particularly limited as long as it prevents the metallic ingredient of the magnetic metal particles from oxidizing over long or semipermanently. However, examples thereof include dense oxides, and metal oxides are preferred from the standpoints of strength, film-forming properties, and the like.

Examples of metal oxides usable as the oxidation-preventive film include oxides of metals such as silicon, titanium, aluminum, zirconium, tin, iron, manganese, nickel, chromium, zinc, cadmium, lead, lithium, indium, neodymium, bismuth, cerium, antimony, calcium, magnesium, barium, and the like.

Examples of methods for producing the magnetic powder for use in the magnetic fluid of the present invention, i.e., the magnetic metal particles coated with an oxidation-preventive film, include: (1) a process comprising forming an oxidation-preventive film of a metal oxide or the like on the surface of base particles comprising a ferromagnetic metal; and (2) a process which comprises forming a hydroxide film on the surface of oxide particles serving as a raw material of magnetic metal particles and reducing the raw oxide particles coated with the hydroxide film.

In process (1), base particles comprising a ferromagnetic metal are formed by the plasma method, a vapor-phase film deposition method (CVD or PVD), or the like. When these metallic base particles are stably present in a solvent, a hydroxide film is formed thereon by a sol-gel method or another method. The coated base particles are heated in vacuum or an inert gas atmosphere to thereby convert the coating film into a tenacious oxidation-preventive film.

Process (2) will be explained below in detail.

The oxide particles serving as a raw material for magnetic metal particles (hereinafter referred to as "raw oxide particles of magnetic metal particles") are ones in which the oxide upon reduction becomes a ferromagnetic elemental metal or a ferromagnetic metal alloy.

Examples of the raw oxide particles of magnetic metal particles include ferrite particles represented by magnetite, cobalt ferrite, and nickel ferrite and composite metal ferrite particles.

There raw oxide particles of magnetic metal particles can be produced by a known method, such as coprecipitation, reduction of metal ions, CVD, or the like. Especially, in the case of ferrite particles, use of the coprecipitation method can yield fine particles having uniformity in particle diameter, in the range of about from several nanometers to several tens of nanometers.

In the present invention, use may be made of a method in which the raw material for magnetic metal particles is obtained by using a sol-gel method, a gel-sol method, the coprecipitation method, or the like to form oxide particles or hydroxide particles in a solvent.

For example, in the case where the raw material for magnetic metal particles is formed by the coprecipitation method, use may be made of a method in which an alkali solution is added to an aqueous solution of a salt of the raw material to neutralize and hydrolyze the same. In the case where the reaction requires energy, heating is conducted with a water bath, oil bath, autoclave, and the like. Thus, raw oxide particles of magnetic metal particles are formed.

Preferred as the salt of the magnetic metal are salts, such as the chloride, sulfate, nitrate, oxalate, acetate, and carbonate, other inorganic salts, salts with organic acids, and the like.

For forming a hydroxide film on the surface of the raw oxide particles of magnetic metal particles in process (2), (i) a method in which a hydroxide film is formed in an organic solvent with a metal alkoxide, (ii) a method in which a metal salt is neutralized and hydrolyzed in water, and the like, are exemplified.

The method of forming a film of a metal hydroxide by the hydrolysis of a metal alkoxide is conducted in the following manner. The raw oxide particles of magnetic metal particles are dispersed in a solution of a metal alkoxide (the solvent is mostly an organic solvent or a mixed solvent composed of an organic solvent and water). Water or an aqueous weakly alkaline solution is added to the solution containing the dispersed particles to hydrolyze the metal alkoxide and thereby deposit a film of the hydroxide of the metal on the surface of the particles.

Processes for producing particles having a multilayered metal oxide film by this method are described in JP-A-6-228604, JP-A-7-90310, and the like.

This method for hydrolytically producing a metal hydroxide, which is called a sol-gel method, yields an oxide which is fine and homogeneous in composition. By applying this method to raw oxide particles of magnetic metal particles, a dense film having an even thickness is obtained on the raw oxide particles of magnetic metal particles.

As the metal alkoxide is selected an alkoxide of the metal corresponding to the desired metal oxide, such as silicon, titanium, aluminum, zirconium, tin, iron, manganese, and the like.

When a metal alkoxide which decomposes in the presence of water is selected, it is generally used as a solution in an organic solvent. As the organic solvent is used an alcohol, such as ethanol, methanol, or the like, a ketone, or another one. It is preferred to use an organic solvent which has been dehydrated. Although the concentration of the metal alkoxide solution varies depending on the kind of the metal alkoxide to be dissolved and on the kind of the organic solvent, optimal conditions are selected. The thickness of the metal hydroxide film to be deposited on the raw oxide particles of magnetic metal particles is determined by the concentration of the metal alkoxide solution and the use amount of the metal alkoxide solution relative to the amount of the raw oxide particles of magnetic metal particles.

Method (ii), in which a metal salt is neutralized and hydrolyzed in water, is explained below. Among the metal salts for use in a treatment in which the reaction of an aqueous metal salt solution, which is the most common reaction among the reactions of metal salts, is used to cause precipitation, acid salts of metals are especially problematic. Although neutralization and pyrolysis are typical reactions of metal salts, other reactions may be used. Examples of the metal used as the metal salt in the present invention include iron, nickel, chromium, titanium, zinc, aluminum, cadmium, zirconium, silicon, tin, lead, manganese, lithium, indium, neodymium, bismuth, cerium, antimony, and the like, and further include calcium, magnesium, barium, and the like.

Examples of salts of these metals include the salts with sulfuric acid, nitric acid, hydrochloric acid, oxalic acid, carbonic acid, and carboxylic acid. Also chelate complexes of those metals are included. A suitable kind of metal salt is selected for use in the present invention according to the properties to be imparted to the surface of the particles and the means to be used for production.

By treating the raw oxide particles of magnetic metal particles in the manner described above, a hydroxide film can be formed on the raw oxide particles of magnetic metal particles.

Thereafter, the solution containing the thus-obtained, hydroxide-film-coated raw oxide particles of magnetic metal particles is allowed to stand to separate it into a liquid phase and a solid phase. Only the ultrafine particles suspending in the liquid phase are collected. For collecting only the ultrafine particles, a centrifugal separator may be used. These ultrafine particles have an average particle diameter of about 10 nm. Consequently, the ultrafine particles give a magnetic fluid, which will be described later, in which the particles do not sediment but show excellent dispersibility.

These hydroxide-film-coated raw oxide particles of magnetic metal particles are reduced to convert the base into a metal having enhanced magnetism and to convert the hydroxide film into a perfect oxidation-preventive film. Thus, magnetic metal particles coated with the film can be obtained.

The reduction is accomplished by conducting calcining in a hydrogen gas atmosphere maintained in a furnace at a temperature of from 300 to 800° C., preferably from 400 to 700° C. At temperatures of 300° C. or less, there are cases where a perfect oxidation-preventive film is not formed. At temperatures exceeding 800° C., the particles may be sintered. Such temperatures are hence unsuitable.

The time for calcining in this furnace is from 1 to 10 hours, preferably from 3 to 8 hours.

It is thought that in the reduction/calcining treatment in the present invention, the raw oxide particles of magnetic metal particles are reduced to a metal and, simultaneously therewith, the solidification of the oxide film and the melting of a surface of the magnetic metal particles proceed simultaneously due to the high temperature to generate bonds at the interface between the oxide film and the magnetic metal particles. The oxide film is thought to thus become a perfect oxidation-preventive film.

During the reduction/calcining treatment, the oxidation-preventive film serves also as a sintering-preventive film in the reduction treatment.

A rotary tubular furnace may be used for preventing particle sintering and for efficiently converting the oxide-coated magnetic particles into a magnetic fluid.

The reduction/calcining treatment may be conducted under conditions in accordance with the method which itself is known and has been used as a treatment for obtaining acicular magnetic particles (major axis: 0.1 to 0.3 $\mu$m), such as magnetite, maghemite, metallic iron, and the like, which have excellent magnetic properties and are suitable for use mainly in magnetic recording media (e.g., JP-A-59-213626 and JP-A-58-161709). In the present invention, however, the method is used in order to reduce the raw oxide particles of magnetic metal particles for a magnetic fluid to convert the base into a metal and thereby obtain magnetic metal particles coated with an oxidation-preventive film and having enhanced magnetism. The method was applied to ultrafine particles having an average particle diameter of from 5 to 20 nm, and excellent results could be obtained.

Two or more oxidation-preventive films may be formed according to need for the purpose of, e.g., regulating the thermal reactivity thereof with the magnetic metal particles to thereby prevent magnetization diminution.

The average particle diameter of the magnetic metal particles coated with an oxidation-preventive film is in the range of from 5 to 20 nm, preferably from 6 to 15 nm, more preferably from 7 to 12 nm, and most preferably from 8 to 10 nm. Average particle diameters smaller than 5 nm result in reduced magnetism, while average particle diameters larger than 20 nm result in sedimentation in the magnetic fluid. Consequently, such average particle diameters are unsuitable.

The saturation magnetization of the magnetic metal particles coated with an oxidation-preventive film is from 70 to 200 emu/g, preferably from 100 to 200 emu/g.

The thickness of the oxidation-preventive film is from 0.01 to 2 nm, preferably from 0.01 to 1 nm, and more preferably from 0.01 to 0.5 nm. A thickness of the film smaller than 0.01 nm is apt to result in sintering during calcining, while a thickness thereof larger than 2 nm results in reduced magnetism. Consequently, such thicknesses are unsuitable.

In the case where a silica film and iron are used as the oxidation-preventive film and the metallic ingredient of the magnetic metal particles, respectively, the weight proportion of the $SiO_2$ to the Fe ($SiO_2$/Fe) is from 0.1 to 20 wt %, preferably from 0.1 to 10 wt %, and more preferably from 0.5 to 7 wt %.

In the case where another material is used as the oxidation-preventive film or the metallic ingredient of the magnetic metal particles, a preferred weight proportion may be suitably determined.

The formation of a magnetic fluid in the present invention by stably dispersing the magnetic metal particles coated with an oxidation-preventive film in a solvent can be accomplished by suitably selecting the solvent and a dispersant.

For use in dampers and actuators, the solvent as the medium may be water or a highly polar solvent having a relatively high boiling point. Usable solvents include polar solvents such as lower alcohols (e.g., ethanol, propanol, etc.), higher alcohols ranging from ethylene glycol, propylene glycol, and 1,4-butanediol to 1,10-decanol, and the like.

In water or such a polar solvent, the particles are covered with an unsaturated fatty acid such as oleic acid, linolenic acid, or linoleic acid to thereby treat the particles so as to impart an affinity for solvents to the surface thereof. Thereafter, a surfactant such as an anionic surfactant (e.g., dodecylbenzenesulfonic acid, dodecyl sulfate, etc.), a nonionic surfactant (e.g., polyoxyethylene alkyl ether, etc.) or the like is added, followed by a cationic surfactant, such as tetramethylammonium or the like. Thus, a magnetic fluid can be obtained.

Also, a polymeric dispersant, such as a hydroxyalkyl cellulose or the like, can be used.

On the other hand, an unsaturated fatty acid, such as oleic acid or the like, a silicone dispersant, such as a reactive siloxane or the like (e.g., mercapto-modified siloxane, carboxy-modified siloxane, etc.) , or the like can be used for nonpolar solvents, such as hydrocarbons (e.g., kerosine, α-olefins, and alkylnaphthalenes, etc.), ethers (e.g., polyphenyl ethers, etc.), silicone oils (e.g., dimethylsiloxane, etc.), and the like.

One or more of the following various surfactants can be used for the surface treatment. Usable surfactants include anionic surfactants, such as alkali salts of unsaturated fatty acids (e.g., oleic acid, linoleic acid, linolenic acid, etc.), carboxylic acids, (e.g., alkyl ether acetic acids, etc.) and salts thereof, sulfonic acids and salts thereof, sulfuric and sulfurous ester salts, phosphoric esters and salts thereof, boron compounds, polymers obtained by polymerization, polymers obtained by polycondensation, and the like; cationic surfactants, such as aliphatic amines and ammonium salts thereof, aromatic amines and ammonium salts thereof, heterocyclic amines and ammonium salts thereof, polyalkylene polyamine type, polymer type, and the like; nonionic surfactants, such as the ether type, ester-ether type, ester type, polysaccharides (e.g., dextrins, etc.), polymers (e.g., cellulose derivatives, etc., including hydroxyalkyl celluloses, etc.), modified silicone oils (e.g., carboxy-modified and amino-modified silicone oils, etc.) , nitrogen-containing type, and the like; amphoteric surfactants, such as betaine type, organic amino acid type, and the like; and reactive surfactants, such as silane coupling agents and titanium coupling agents; and the like. The addition amount thereof is suitably determined.

Coating with Hydroxide Film

The invention will be explained below in more detail by reference to Examples. However, the present invention should not be construed as being limited to these Examples only.

EXAMPLE 1

Raw Oxide Particles for Magnetic Metal Particles

A solution of 0.125 mol/l ferrous chloride reagent and 0.25 mol/l ferric chloride reagent was prepared in an amount of 150 ml, and 1 mol/l NaOH solution was added thereto to give a pH of 12 to precipitate the iron. Thereafter, the precipitate was repeatedly washed with distilled water by decantation to obtain 20 g of ultrafine magnetite particles. The magnetite obtained had an average particle diameter of 7.5 nm.

Coating with Oxide Film

To 1 liter of an aqueous solution containing 20 g of the thus obtained magnetite, 6.8 g of a water glass having an $Na_2O.3SiO_3$ content of 37.7% was added. This mixture was sufficiently stirred to disperse the water glass. Thereafter, the pH of the mixture was adjusted to 8 with 1 N hydrochloric acid. This mixture was allowed to react for 2 hours in a water bath kept at a temperature of 70° C.

After completion of the reaction, the solid material was taken out by filtration and washed with 5 liters of distilled water to remove the electrolytes.

Production of Ultrafine Metal Particles Coated with Oxide

The solid material was dried and then put in an alumina boat, which was then placed in a tubular furnace. The atmosphere was replaced with nitrogen gas by introducing nitrogen gas for 10 minutes at 500 ml/min. Thereafter, the furnace was heated to 650° C. over 3 hours while passing hydrogen gas therethrough at 500 ml/min, and then kept at that temperature for 5 hours. Subsequently, the furnace was allowed to cool while introducing nitrogen gas, in place of hydrogen, at 500 ml/min.

In the silica-coated ultrafine iron metal particles obtained, the amount of the $SiO_2$ coating was 3.5 wt % based on the iron. The silica-coated ultrafine iron metal particles obtained had an average particle diameter of 9.5 nm.

The magnetization thereof in a magnetic field of 10 kOe was 125.5 emu/g.

Furthermore, no oxidation was observed in the air at temperatures up to 150° C.

Formation of Magnetic Fluid

To 100 ml of 10% aqueous oleic acid solution, 10 g of the thus obtained silica-coated ultrafine iron metal particles was added, followed by stirring to cause the particles to adsorb oleic acid. Thereafter, the precipitate was taken out by filtration and washed with 1 liter of water 8 times in order to remove the excess oleic acid. The powder recovered by filtration was dried at 60° C. for 8 hours.

To the dried powder, 3.2 g of dodecylbenzenesulfonic acid and 2.9 g of ethylene glycol containing 0.5 g of tetramethylammonium were added, followed by stirring with a homogenizer at 1,100 rpm for 2 hours. Thus, a magnetic fluid was obtained in which the concentration of the silica-coated ultrafine iron metal particles was 60%.

The magnetic fluid obtained had a viscosity of 220 cP and excellent dispersion conditions. The magnetization thereof in a magnetic field of 10 kOe was 72.6 emu/g. In 20-week standing, no change in magnetism was observed.

EXAMPLE 2

In the same manner as in Example 1, a magnetic fluid containing silica-coated ultrafine iron metal particles at a concentration of 70% was produced. This magnetic fluid was compared in pressure resistance with a magnetic fluid having a magnetite concentration of 70% produced by the method described in JP-A-54-40069.

A pressure test was conducted in the following manner. Five ring-form permanent magnets were sandwiched between six ring-form ball pieces so that the N and S poles were arranged alternately. A shaft was passed through these magnets and ball pieces. Each magnetic fluid was intimately disposed between the tip of the ball pieces and the shaft to obtain a six-stage pressure seal. One side of the ball pieces was pressurized with nitrogen gas, and the pressure at which the magnetic fluid seal broke was measured.

When the magnetic fluid containing magnetite at a concentration of 70% was used, the withstand pressure was 960 g/cm$^2$. On the other hand, the magnetic fluid according to the present invention, which had a concentration of 70%, was found to have a withstand pressure of 6,300 g/cm$^2$, which was at least 6 times.

EXAMPLE 3

Magnetic Fluid Based on Silicone Oil

To a solution prepared by dissolving 40 g of a mercapto-modified siloxane in 600 g of xylene, 120 g of silica-coated ultrafine iron metal particles produced in the same manner as in Example 1 was added, followed by stirring for 2 hours to obtain a mixed solution.

This mixed solution was further mixed with 40 ml of dimethylsiloxane, and the resultant mixture was placed in a three-necked separable flask. In an oil bath, the mixture was stirred for 8 hours with a motor at 800 rpm at a constant liquid temperature of 70° C., while introducing nitrogen gas through one neck and discarding the evaporating xylene through another. Thus, 55 ml of a dimethylsiloxane-based magnetic fluid containing silica-coated ultrafine iron metal particles was obtained.

In this magnetic fluid, the content of the silica-coated ultrafine iron metal particles was 60%. The magnetization of the magnetic fluid in a magnetic field of 10 kOe was 70 emu/g.

This magnetic fluid had a viscosity of 1,100 cP. This magnetic fluid was also stable over 20 weeks and showed no change in magnetism.

INDUSTRIAL APPLICABILITY

As described above, according to the magnetic fluid and the process for producing the same of the present invention, an excellent magnetic fluid is obtained which mightily and precisely actuates by the action of an external magnetic field and has a magnetism at least two times those of conventional magnetite-containing magnetic fluids. Furthermore, a high-performance magnetic fluid having unsusceptibility to oxidation and satisfactory dispersion stability can be easily obtained. These magnetic fluids are exceedingly suitable for practical use as a working fluid for dampers, actuators, shaft seals, vacuum seals, dynamic bearings, and the like.

What is claimed is:

1. A magnetic fluid comprising magnetic metal particles coated with an oxidation-preventive film having a thickness of from 0.01 to 0.5 nm stably dispersed in a solvent, wherein the dispersion conditions are maintained, and wherein the magnetic metal particles coated with the oxidation-preventive film have an average particle diameter of from 5 to 20 nm, said magnetic fluid being prepared by forming a hydroxide film on the surface of raw oxide particles of magnetic metal particles, reducing the raw oxide particles coated with the hydroxide film to obtain magnetic metal particles coated with an oxidation-preventive film, and stably dispersing the magnetic metal particles coated with an oxidation-preventive film in a solvent.

2. The magnetic fluid according to claim 1, wherein the magnetic metal particles coated with an oxidation-preventive film have a saturation magnetization of from 70 to 200 emu/g.

3. A process for producing a magnetic fluid, comprising forming a hydroxide film on the surface of raw oxide particles of magnetic metal particles, reducing the raw oxide particles coated with the hydroxide film to obtain magnetic metal particles coated with an oxidation-preventive film, and stably dispersing the magnetic metal particles coated with an oxidation-preventive film in a solvent.

4. The process for producing a magnetic fluid according to claim 3, wherein the raw oxide particles of magnetic metal particles have a particle diameter of from 5 to 20 nm.

5. The process for producing a magnetic fluid according to claim 3, wherein the raw oxide particles coated with a hydroxide film is reduced by calcining at 300 to 800° C. in a hydrogen gas atmosphere.

* * * * *